United States Patent [19]

Rieman et al.

[11] 4,205,891

[45] Jun. 3, 1980

[54] RADIO FREQUENCY INTERFERENCE SUPPRESSOR CONNECTOR

[75] Inventors: Willis E. Rieman, Skaneateles; Robert J. Duffany, Scipio Center, both of N.Y.

[73] Assignee: Gulf & Western Manufacturing Company, New York, N.Y.

[21] Appl. No.: 932,261

[22] Filed: Aug. 9, 1978

[51] Int. Cl.[2] ..... H01R 3/04

[52] U.S. Cl. ..... 339/126 R; 339/147 R

[58] Field of Search ..... 339/147 R, 147 C, 147 P, 339/147, 126 R, 128, 176 R, 176 M; 310/71, 72

[56] References Cited

U.S. PATENT DOCUMENTS

| | | | |
|---|---|---|---|
| 2,318,861 | 5/1943 | Huguelet | 339/147 P |
| 3,659,252 | 4/1972 | Brown | 339/147 R X |
| 3,699,500 | 10/1972 | Borzoni | 339/147 P X |
| 3,790,915 | 2/1974 | Dugan | 339/128 X |
| 4,113,341 | 9/1978 | Hughes | 339/147 R |

*Primary Examiner*—Joseph H. McGlynn
*Assistant Examiner*—John S. Brown
*Attorney, Agent, or Firm*—Meyer, Tilberry & Body

[57] ABSTRACT

An electrical connector for electrical apparatus including a built-in capacitor for suppressing the generation of or preventing high frequency energy generated internally of the apparatus from being radiated externally of the apparatus through the power supply wires. The connector includes a fixed insulating housing adapted to be mounted on the conductive case of the apparatus and an electrically conductive member extending therethrough having one end exposed to the outside of the fixed housing for detachable connection to a movable connector and the other end extending through the case for connection to the electrical apparatus on the inside. The fixed housing has on the side adjacent to the apparatus case a cavity with mid portions of the conductive member extending along one wall thereof. An electrical capacitor is positioned in this cavity with one terminal connected to the conductive member and the other terminal engaging a second electrically conductive member having a portion extending outside of the fixed housing and adapted to engage the case of the apparatus.

12 Claims, 14 Drawing Figures

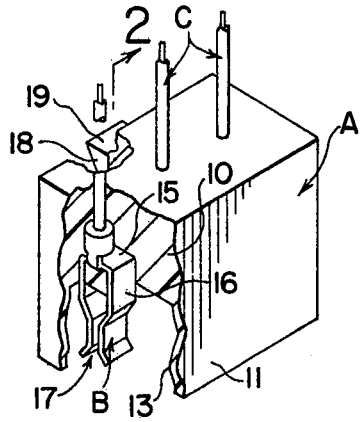
FIG. 1
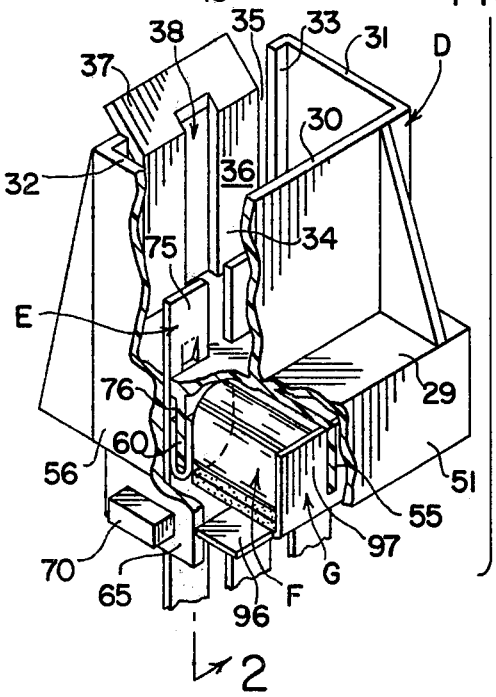
FIG. 2
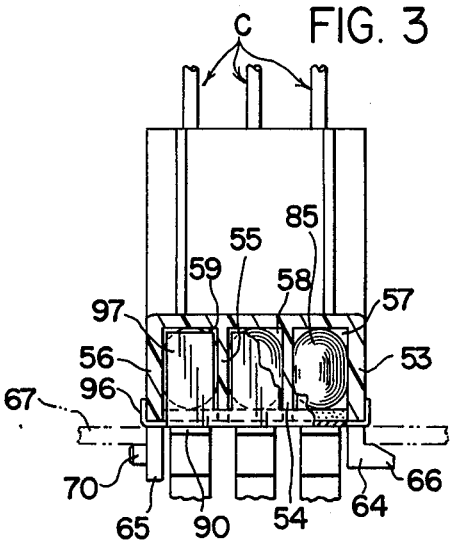
FIG. 3
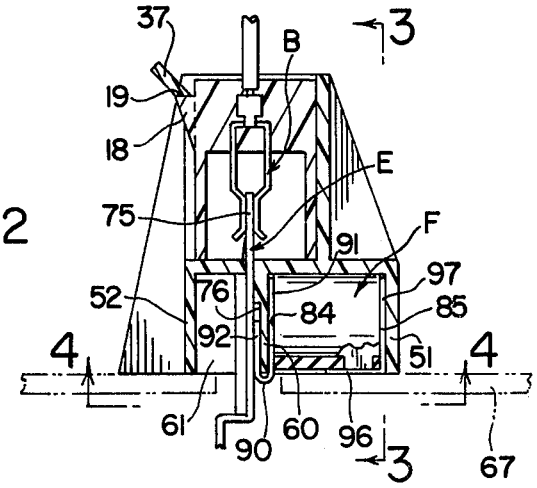

FIG. 4
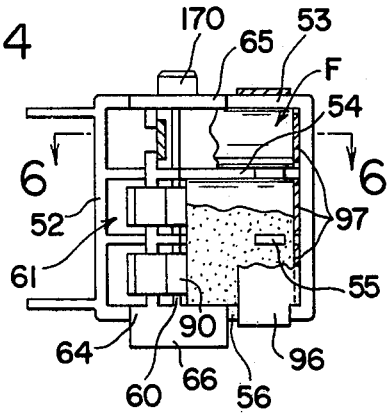
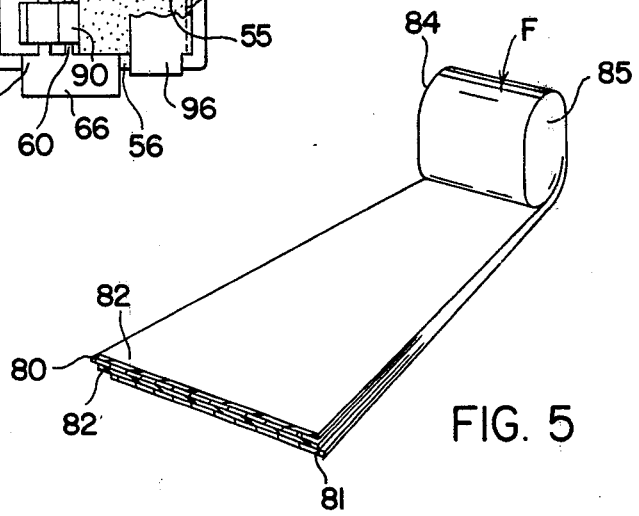
FIG. 5
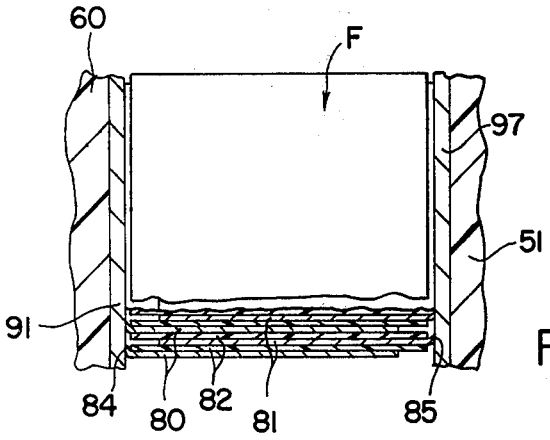
FIG. 6

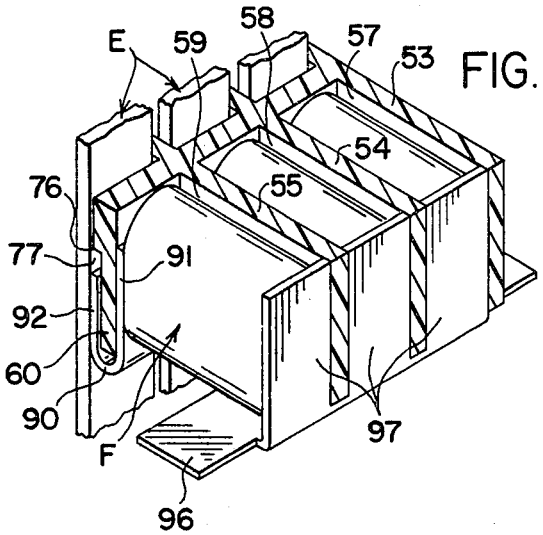
FIG. 7
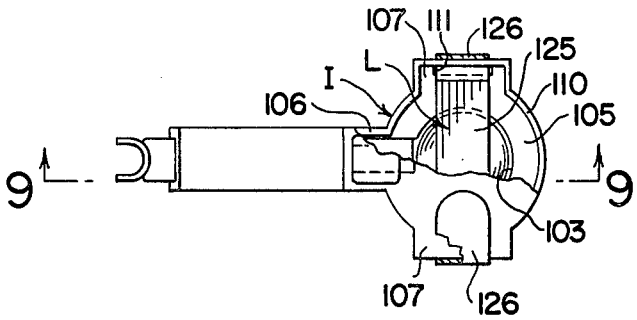
FIG. 8
FIG. 9
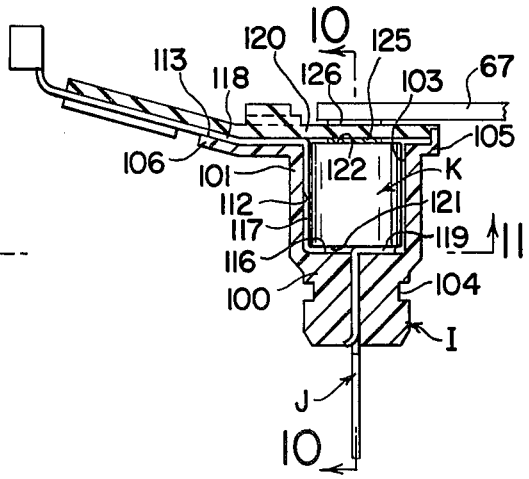
FIG. 10
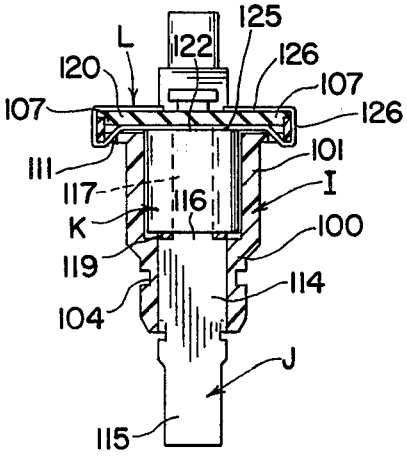
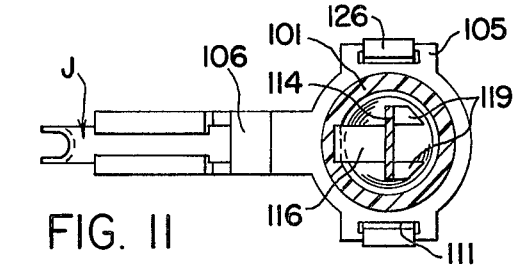
FIG. 11

FIG. 12
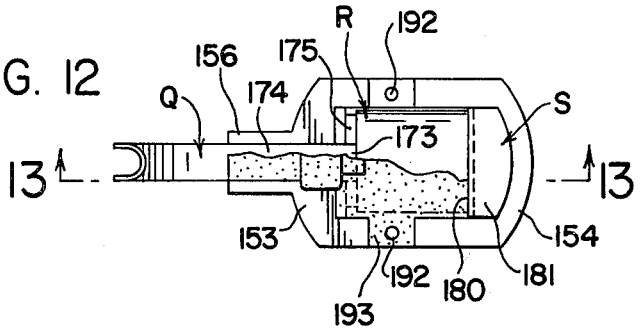
FIG. 13
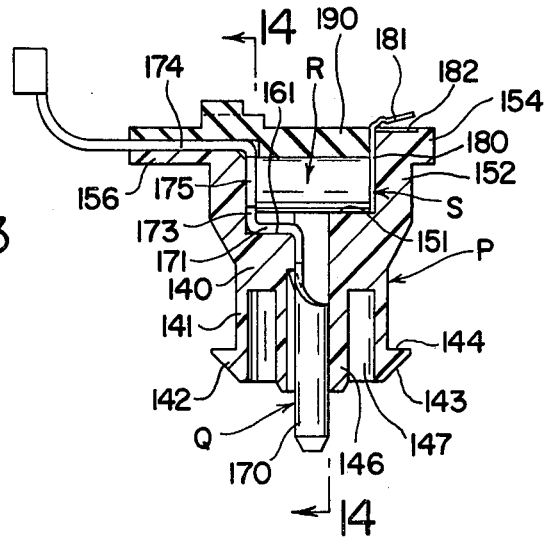
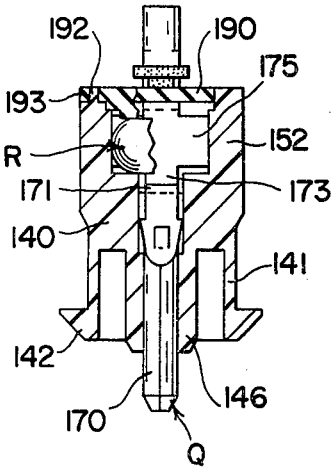
FIG. 14

RADIO FREQUENCY INTERFERENCE SUPPRESSOR CONNECTOR

This invention pertains to the art of electrical connectors and more particularly to an electrical connector adapted to be mounted on the case of electrical apparatus and having provision for receiving a capacitor for suppressing or bypassing high frequency radio energy to ground.

The invention is particularly applicable to detachable electrical connectors of the type used to supply electric power to the 12 volt electric motors used for actuating windshield wipers, blowers, and windows of automotive vehicles and will be described with particular reference thereto although it will be appreciated that the invention has other and broader uses.

Electric motors used in automotive vehicles are ordinarily of the DC commutator type. The commutation of the DC power in these motors frequently generates spurious high frequency radio energy, sometimes of a considerable magnitude which energy is conducted by or radiated from the wires connected between the motor the other parts of the vehicle where such energy interferes with radio reception and/or the operation of computer circuitry now used in automobiles and in some cases this energy can be sufficiently severe as to cause damage to such equipment, particularly the latter.

Various means have been proposed in the past for suppressing this radio frequency energy such as a radio frequency choke placed in series with each power lead, the inductance of which chokes provides a high impedance to passage of high frequency radio energy and either prevents (or attenuates) the passage of the high frequency energy to the power leads. Alternatively, feed-through type capacitors have been provided which bypass one of the power leads to ground such that the capacity of the capacitor provides a low impedance circuit for the high frequency energy thus bypassing this high frequency energy to the ground circuit and preventing it from traveling through the ungrounded power lead.

In the case of radio frequency chokes, these must be made heavy enough to carry the total current drawn by the electric motor which current can be relatively high, for example, when the motor is in a stalled or semi-stalled condition. Thus, the radio frequency chokes must have relatively large diameter wires, sometimes require a magnetically permeable core, and are bulky, expensive to manufacture and are subject to failure, for example, when the motor stalls and draws excessive amounts of current. Furthermore, the radio frequency choke does nothing to prevent the generation of the high frequency energy within the apparatus itself. The only thing it can do is to prevent or attenuate the passage of the high frequency energy to the power supply wires.

In the case of feed-through capacitors, these must also be made to carry the total current drawn by the electric motor and are thus subject to failure due to such currents. Additionally, they are usually bulky in size and it is generally impossible to manufacture a feed-through type capacitor of sufficient capacity to provide the low impedance bypass required and/or to in fact suppress the actual generation of the high frequency energy within the apparatus itself. Capacitors having sufficient capacity to prevent generation of the high frequency energy generally have such long lead lengths or such high internal inductance as to limit their suppressing characteristics at the higher frequencies.

It is conventional in the art of electric motors used in automobile vehicles to provide an electrical connector for such motor comprised of a fixed housing of insulating material mounted on the motor casing and having an elongated electrically conductive member extending therethrough, this member having an inner end connected to one terminal of the motor and an outer exposed or bare end so as to be readily engaged by a connector member on the end of a power supply or other wire.

The present invention contemplates a new and improved electrical connector capable of having incorporated therein a capacitor of sufficient capacity and sufficiently low inductance leads as to effectively suppress the generation of radio frequency energy in the motor or to bypass such energy to the ground and to otherwise overcome the difficulties of the prior art.

In accordance with the invention, an electrical connector adapted to be mounted on the case of an electrical apparatus is provided which connector includes: an insulative housing having means integrated therein for cooperating with the case for mounting thereon, an internal cavity adapted to receive a high capacity, low inductance capacitor, a first electrically conductive member extending through the housing forming one wall of the cavity so as to provide a short, direct connection with one ultra short terminal of the capacitor when installed, and a second electrically conductive member adapted to extend across the other end of the cavity adapted to short couple the other short terminal of the capacitor to ground via the case of the electrical apparatus. Coupling between members is so designed that the antenna functions, inductance and radio frequency impedance of the connections between the terminals of the capacitor and the apparatus are the absolute minimum while the capacitor has a minimum capacity for a given physical size. As such, the capacitor provides a minimum impedance to the passage of high frequency radio energy from the power lead to the casing of the motor and at the same time may have sufficient capacity to, in some respects, suppress (or prevent) the generation of the high frequency energy within the motor itself. Thus radiation of such energy is attenuated.

Thus, in DC electric motors, high frequency energy is usually generated when a commutator segment breaks its contact with a brush. At this instant the stored energy in the inductance of the armature winding connected to that segment causes a high voltage to appear on the segment which voltage momentarily arcs to the brush generating a high frequency signal. The present invention, by placing a large capacitor with low internal and lead inductance in close proximity to the brush, effectively absorbs this stored energy and prevents or suppresses the generation of the high frequency energy.

To do this in accordance with the invention, the capacitor is of the type having two opposed layers of ribbon foil separated by a thin ribbon of dielectric material. One edge of one foil extends slightly beyond the corresponding edge of the dielectric while the one edge of the other foil extends slightly beyond the other edge of the dielectric. The four ribbons are wound into a compact cube with the entire exposed edges of the two foils forming opposed ends of the cube and thus the terminals for the capacitor. The entire end areas of the capacitor thus pressure engage flat surfaces on relatively wide electrically conductive members thus providing a capacitive circuit with an absolute minimum of series inductance or resistance and thus impedance to the passage of high frequency energy.

The connector may have one or a plurality of electrically conductive power leads extending therethrough, each with a bare portion exposed to the cavity in the housing and an equal number of capacitors may be positioned in the housing, one for each electrically conductive member extending therethrough.

In some instances, it will be appreciated that when radio frequency suppression is unnecessary, the capacitor may be omitted in which case the internal cavity is left empty. Thus, the connector may be used interchangeably, either with or without the capacitor incorporated into its cavity.

The new principal object of the invention is the provision of a new and improved electrical connector for electrical apparatus which has a tendency to generate spurious high frequency radio signals, which connector actively suppresses the generation of such high frequency energy or bypasses any high frequency energy generated to ground.

Another object of the invention is the provision of a new and improved electrical connector including a housing of electrically insulating material and having an internal cavity, an electrically conductive member extending therethrough with a mid portion thereof extending adjacent a wall of the cavity and an electrical capacitor in the cavity with one terminal thereof engaging the mid portion and the other terminal engaging an electrically conductive member which extends externally of the connector and engages the casing of the electrical apparatus.

Another object of the invention is the provision of a new and improved electrical connector having a cavity therein opening to the inner end, a capacitor in such cavity with one terminal facing the open end of the cavity an electrical conductive member extending across the end of the cavity in engagement with the terminal and arranged so as to also engage the casing of the apparatus on which the connector is to be mounted.

Another object of the invention is the provision of a new and improved electrical connector which will effectively suppress or prevent the generation or radiation of high frequency electrical energy therebeyond which is simple in construction, economical to manufacture and has a minimum of bulk.

Another object of the invention is the provision of a new and improved electrical connector having a bypass capacitor incorporated therein wherein the housing for the connector and the capacitor may be separately manufactured and assembled in a later step.

Another object of the provision of a connector housing arrangements which for substantially the same cost of manufacturing has provisions for incorporating a capacitor therein for radio frequency suppression.

The invention may take form in certain parts and arrangement of parts, preferred embodiments of which will be described in detail in this specification and illustrated in the accompanying drawings which form a part hereof and wherein:

FIG. 1 is a perspective view of an electrical connector comprised of a fixed portion adapted to be mounted on the casing of a motor and a movable portion, the two portions being shown in exploded view and illustrating a preferred embodiment of the present invention;

FIG. 2 is a cross sectional view of the connector of FIG. 1 taken approximately on the line 2—2 thereof but showing the two connectors in mating relationship;

FIG. 3 is a similar view of FIG. 2 on the line 3—3 thereof;

FIG. 4 is a fragmentary view of the connector of FIG. 2 showing the arrangement of three capacitors and the electrically conductive members which are connected thereto;

FIG. 5 is a enlarged view with portions broken away, showing details of the construction of the capacitor with its layer of insulation and the two foils;

FIG. 6 is an enlarged fragmentary cross sectional view of FIG. 4 taken on the line 6—6 thereof;

FIG. 7 is an enlarged fragmentary view of FIG. 1 showing the arrangement of the capacitors and their connectors;

FIG. 8 is a end view with portions broken away for the purposes of clarity of a connector illustrating an alternative embodiment of the invention;

FIG. 9 is a cross sectional view of FIG. 8 taken approximately in the line 9—9 thereof;

FIG. 10 is a cross sectional view of FIG. 9 taken approximately in the line 10—10 thereof;

FIG. 11 is a cross sectional view of FIG. 9 taken on the line 9—9 thereof;

FIG. 12 is a end view with portions broken away for the purposes of clarity of a connector illustrating a further alternative embodiment of the invention;

FIG. 13 is a cross sectional view of FIG. 12 taken approximately in the line 13—13 thereof; and, FIG. 14 is a cross sectional view of FIG. 13 taken approximately in the line 14—14 thereof.

Referring now to the drawings wherein the showings are for the purposes of illustrating preferred embodiments of the invention only and not for the purposes of limiting same, FIG. 1 shows an electrical connector comprised of a movable housing A, having incorporated therein suitable contacts B connected to power supply wires C, which movable housing is adapted to coact and mate with a fixed housing D having electrically conductive members E extending therethrough, electrical capacitors F having one terminal electrically connected to the conductive members E and another connected to an electrically conductive member G which in turn contacts the case (not shown) of an electric motor.

The movable housing A of the connector forms no part of the present invention and may take any desired shape or configuration. In the embodiment shown, it is comprised of a generally rectangular block 10 of electrically insulating material having depending side walls 11 defining an open ended cavity 13 in the lower end. The electrical contact members B also form no part of the present invention and are each generally comprised of a U-shaped clip bent from a flat strip of copper or brass having a base 15 and a pair of downwardly extending legs 16, the lower ends of which are spaced as at 17 to receive the upper end of the electrically conductive members E. Preferably the lower ends 18 of the legs 16 diverge to aid in the space 17 being aligned with the conductive member E. The contact members B may be supported in the movable housing A in any desired manner but as shown the base 15 is molded into the base of the cavity 13.

Conductors C also form no part of the present invention. Each are connected by crimping or soldering to the base 15 and extend outwardly through the top of the block 10.

The fixed housing D except for the cavity for receiving the capacitors F in electrical contact with the conductive members E, G forms no part of the present invention and may take any one of a number of different forms. In the embodiment shown, the housing D has a base 29 from which four upstanding walls 30, 31, 32, 33 extend defining an upwardly opening cavity 34 which cavity is of a dimension so as to slidingly receive the movable connector A. The wall 33 has a pair of vertically extending slits 35 such that the intervening portion of the wall 36 is resilient relative to the remainder of the walls and can spring slightly outwardly therefrom. The upper end of the wall 36 diverges outwardly and upwardly as at 37 so as to provide a guide for inserting the movable connector A into the cavity 34. The wall 36 has a vertical slit 38 which receives a dog 18 on one side of connector A having an upwardly facing shoulder 19 which engages under the outwardly angled portion 37 to lock the movable portion of connector A in the cavity 34, all as is conventional in the art.

Extending downwardly from the base 29 are parallel walls 51, 52 and at right angles thereto parallel walls 53, 54, 55, 56 which with base 29 define in accordance with the invention, in this case, three open ended cavities 57, 58, 59 in the housing D which cavities as shown, open downwardly through the lower end of the housing D. In addition, extending downwardly from the base 29 is a wall 60 defining with the ends of the walls 53, 54 and base 29 an open ended cavity 61.

Legs 64, 65 extend downwardly from the middle of walls 53, 56 with leg 64 having a sidewardly extending lug 66, the upper surface of which define with a downwardly facing surface on wall 53, a clearance to receive the edge of the motor casing 67. Leg 65 has a sideward lug 70 which fits under the casing 67 to lock the fixed housing D in place on the casing 67 with the lower edges of walls 51, 52 and 53 in engagement therewith.

The electrically conductive members E are generally elongated, are formed from a strip of electrically conductive metal and extend through a correspondingly shaped opening in the base 29 with the upper end 75 exposed in the cavity 34 and the lower end extending adjacent one of the cavities 57, 58, 59 through the lower end of the housing D and through an opening in the motor casing 67 where the lower end has means for connection to the electrical apparatus as is conventional. It will be noted that the left hand side of the wall 52 is generally recessed as at 76 for reasons which will appear hereinafter. The mid portion of the electrically conductive member E has a wide bare surface 77 exposed to this recess 76 to which electrical contact can be made.

One capacitor F is positioned within each cavity 57, 58, 59. These capacitors are in the shape of a cube and made up of a tightly wound coil of two thin ribbons of metallic foil 80, 81 (see FIGS. 5 & 6) of generally the same width separated by a thin ribbon 82 of dielectric film which is of the same general width as the metallic ribbons. The metallic ribbons 80, 81 are so oriented edgewise relative to the dielectric ribbon 82 that the edge of one metallic ribbon extends just beyond one edge of the dielectric ribbon while the edge of the other ribbon of metallic foil extends just beyond the other edge of the dielectric ribbon. Each capacitor F is a compact, solid, spiral cube of alternating ribbons of metallic foil and dielectric material with the edge of one metallic foil exposed at one end of the cube and the edge of the other metallic film exposed at the other end of the coil. The edges of the two metallic foils are thus exposed on opposite axial ends of the capacitor and fold over to form first an second terminals 84, 85 for the capacitor of an area equal to the cross sectional area of the cube. The result is a capacitor having a maximum capacity for a minimum volume and with one edge of each foil 80, 81 over its entire length forming a contact terminal for the capacitor. In this respect, it may be said that the entire axial ends of the capacitor are the terminals of the capacitor. Thus, for a capacitor 0.600" (143 mm) in axial length, the maximum distance which any electric current or voltage must flow in the capacitor to reach the most remote point of the aluminum foil is approximately 0.500" (125 mm). The capacitor has a maximum capacity with a minimum of internal inductance. As a result, it has a minimum internal impedance to high frequency radio energy. While the exact construction of the capacitor is not novel, the provision of a cavity in the connector for such a capacitor and the arrangements for connecting to its terminals is believed novel and contributes substantially to the ability of the invention to suppress the generation of radio frequency energy in the electrical apparatus and/or to bypass any generated to the case of the apparatus, and prevent functional antenna radiation.

In accordance with the invention, means are provided for electrically connecting substantially the entire area of these terminals 84, 85 to either a bare portion of electrically conductive member E and the motor casing 67 with a minimum inductance connection. To connect to the bare portion 77 of the conductive member E, a U-shaped connector 90 is provided having a pair of parallel legs 91, 92, one in engagement with the terminal 84 and the other in engagement with a bare portion. The clip 90 extends on both sides of the wall 52 with the leg 92 in recess 76. Inasmuch as there are three capacitors in the connector shown in FIGS. 1–3 there are three of such connectors, each connecting to a separate conducting member E.

To connect the terminal 85 to the motor casing an L-shaped connector G is provided having a base leg 96 extending across the open end of the cavities 57, 58 and 59, the outer surface of which engages the motor casing 67 over a large area as is shown in FIG. 2. The vertical leg 97 of the L has two vertical slits therein to provide room for side walls 54, 55 and which divide the legs into three upstanding portions extending between the terminal 85 of the capacitors and the inner surface of the wall 51. The length of the cavities 57, 58 and 59, the thickness of the legs 97, thickness of the legs 91 and the length of capacitors F are all such that capacitors have an interference fit when assembled so that the sides of the conductive members are pressed into tight electrical engagement with the terminals 84, 85. Springs could be interposed if desired to provide this tight fit.

In some instances the electrically conductive members E could extend on the opposite side of wall 52 in which case the U-shaped clips 90 would not be required. With the arrangement shown, a good low inductance, low resistance electrical connection is provided from the terminal 84 to the conductive member E and the conductive member E is rigidly supported with the fixed housing D.

If desired the open space around the capacitors F can be filled with a hardened insulating material such as anepoxy, pitch or the like.

In practice the connector is mounted on the motor casing in such a manner that the base leg 96 of connector G firmly engages the casing over a wide area. This provides a low impedance connection to the motor casing which is not only grounded but forms a shield around the apparatus to prevent any direct radiation of high frequency energy.

FIGS. 8 to 11 shows an alternative embodiment of the invention. Here the connector is comprised of: a fixed housing I, an electrically conductive member J extending therethrough, a capacitor K positioned in a cavity in the housing and, a second electrically conductive member L providing the ground connection for the capacitor K.

The housing I includes a generally cylindrical base 100 and cylindrical side walls 101 extending upwardly therefrom to define an upwardly opening cavity 103 in which the capacitor K is adapted to be positioned. The base 100 in this embodiment is relatively thick and has a groove 104 around its periphery adapted to coact with a movable connector (not shown) to retain same in place. Additionally, the lower corner of the base 100 is beveled to assist in assembling the movable connector with the housing L.

The upper ends of the side walls 101 have radial flange 105 therearound with an arm 106 and a pair of diametrically opposed lugs 107 extending radially therefrom spaced 90° from the arm 106. The upper side of the flange is recessed leaving a narrow wall 110 surrounding the recess. The lugs 107 each have a narrow slot 111 extending vertically therethrough just radially outwardly of the outer surface of the side walls 101.

The base 100 has a vertically extending slot therethrough and an axially extending groove 112 on the inner surface of the side wall 101. This groove connects to a radially extending groove 113 in the upper surface of arm 106.

The electrically conductive member J is formed from a strip of copper or brass and includes: a first portion 114 extending through the slot in the base 100; a second exposed or bare portion 115 to which electrical connections can be made when the movable connector is installed thereon; a third bare portion 116 extending across and adjacent the base of the cavity; a fourth portion 117 extending axially in the groove 112; and, a fifth portion 118 extending radially in the groove 113 to suitable means for connecting to the motor or otherwise (not shown). Portion 116 also includes ears 119 which extend in the opposite direction across the base of cavity 103 to provide a maximum area of engagement for one terminal of capacitor K.

An electrically insulating cover 120 fits in the recess define by wall 110 and closes the end of the cavity 103 and also extends radially to cover the side of the radially extending portion 119 of the conductor member J.

The capacitor K in the embodiment shown is generally in the shape of a cylinder with the axial ends forming terminals 121, 122 therefor. The capacitor K is inserted into the cavity 103 with its axis vertical so that one terminal 121 engages the bared portion 116, 119 of the horizontally extending bared portion of the member J.

The axial length of the capacitor K is generally equal to the axial depth of the cavity 103.

The electrically conductive member L in the embodiment shown is in the form of a flat ribbon of electrically conductive material with its mid portion 125 extending across the open end of the cavity 103 in electrical contact with the upper terminal 122 of the capacitor K and its ends 126 extending downwardly through slots 111 and are then reverse bent around the ends of the lugs to overlap the outside of the insulating cover 120 generally as is shown. The upper sides of these ends 126 engage the case (not shown) of the motor to ground the upper end of the capacitor K through a relatively wide low resistance, low inductance electrical connection.

FIGS. 12, 13 and 14 show a still further alternative embodiment of the invention. In this embodiment the fixed connector includes an insulated housing P, electrically conductive means Q extending therethrough, a capacitor R having one terminal engaging this electrically conductive member and a second electrically conductive member S providing the ground connection for the other terminal of the capacitor.

In this embodiment, the housing P again includes a generally cylindrical base 140 having a first outer cylindrical wall 141 depending therefrom the lower end of which wall terminates in a radially outwardly extending flange 142 having an upwardly and outwardly diverging lower surface 143 and a flat upwardly facing shoulder 144.

Additionally, a generally cylindrical boss 146 extends downwardly from the base 140 coaxial with and spaced from the wall 141 to define a space 147 which receives a cylindrical sleeve on a male movable connector (not shown). Boss 146 and base 130 have a cylindrical passage therethrough opening into cavity defined by a base surface 151 and upwardly extending side walls 152. Flanges 153, 154 extend sidewardly from the upper end of side walls 152, one of which flanges 153 has a radially extending arm 156 integral therewith.

The base 151 of the cavity has a rectangular groove 161 aligned with a groove in the upper surface of flange 153 and arm 156, both of which grooves are adapted to receive portions of the electrically conductive member Q.

Electrically conductive member Q in the embodiment shown is comprised of: a first generally cylindrical portion 170 positioned in the cylindrical passage of the boss 146; a flat horizontal portion 171 in the groove 161; a flat vertical portion 173 against side wall 152; and a further flat horizontal portion 174 positioned in and beyond the groove in flange 153 and arm 156. In this embodiment, at least vertical portion 173 has a pair of ears or lugs 175 all of which are bare. An entire end area or terminal of capacitor R is in pressure contact with this bare portion contact with this bare portion of conductive member Q to provide a low inductance low resistance electrical connection thereto.

Electrically conductive member S forms a connection from the other terminal of the capacitor R to the casing (not shown) of the motor. In this embodiment, electrically conductive member S is L-shaped and includes a vertical leg 180 positioned between the wall 152 opposite from the electrically conductive member Q and in pressure engagement with the entire other end of terminal of the capacitor R. The base 181 of the L extends radially outwardly, diverging slightly from a shallow groove 182 formed in the upper surface of the flange so that when the connector is installed on the casing of the motor, this base 181 will be compressed tightly against the casing to provide a low resistance, low inductance ground connection thereto.

In the embodiment of the invention shown, a cover 190 for the upper end of the cavity 150 is provided which cover is of insulating material and shaped to have a portion which fits into the upper end of the cavity to firmly hold the capacitor R in the cavity and to cover the portion 170 of the electrically conductive member.

Normally, the axial length of the capacitor R is such that there is an interference fit between the bare portions of the two electrically conductive members, but it will be noted that when the base 181 of the electrically conductive member is compressed, the result is that the leg 180 is pressed into even firmer physical contact and thus an improved electrical contact with the end terminal of the capacitor R results.

In the embodiment shown, the upper ends of the side walls have a pair of notches oriented 90° from the arm 156 which notches each have an upwardly extending pin 192 in the middle. The cover has corresponding ears 193 with openings therethrough which fit into these notches and over the upstanding pin 192 all for the purpose of holding the insulating cover 190 in position.

In all of the embodiments shown the electrically conductive members E, J or Q are in the form of a flat, wide, band or strip of electrically conductive material. Such a shape, as is known, has a minimum inductance and thus a minimum impedance to the flow of high frequency energy from the point of electrical connection to its respective capacitor F, K or R to the point of connection to the electrical apparatus. The physical distance between these points of connection can be extremely short such that this portion of the conductive members do not or cannot function as an antenna by which any high frequency energy not suppressed can be radiated. This can become particularly important where the motor casing is either not entirely of metal, or otherwise is so constructed as not to be a perfect shield to enclose and prevent the radiation of high frequency energy generated inside of the casing.

Tests have shown effective suppression of high frequency energy up to 108 MHz.

Further the construction enables definite position high area contact between the conductor members and the capacitors without the need for solder or other means for establishing firm corrosion proof electrical connections.

It will thus be seen that electrical connectors for electrical apparatus encased in a conductive housing has been described which: in all instances includes a housing of insulating material having an open ended cavity therein; an electrically conductive member extending through the housing and adjacent the cavity, the cavity being adapted to receive a capacitor therein of the type wherein its ends are edges of the capacitor plates which form the terminals thereof in conjunction with means for proving low impedance connections to the electrically conductive member and the casing of electrical apparatus on which the connector is mounted; accomplishes all of the object of the invention and others; the use of a high capacity capacitor having minimum impedance terminals; provides connections to the electrical apparatus having a minimum impedance, can be used either with or without a capacitor; and is able to either suppress the generation of or radiations of or bypass to the casing of the electrical apparatus any high frequency energy generated.

Having thus defined the invention, it is claimed:

1. In a connector adapted to be mounted on a metal case of electrical apparatus, which connector includes: a fixed housing having means at its inner end for coacting mounting on said case; and, a first electrically conductive member extending through said housing having a first exposed end at the outer end of the housing for detachable electrical connection to a movable electrically conductive member and a second exposed end at the inner end of the housing for electrical connection to said electrical apparatus: the improvement which comprises: said housing having a cavity adjacent said housing inner end defined by a plurality of walls, said first conductive member having a bare portion exposed to the inside of said cavity; an electrical capacitor positioned in said cavity and having a first end forming a first terminal electrically connected with said first conductive member bare portion and a second end forming a second terminal; and, a second electrically conductive member in electrical contact with said second terminal and having a second electrically conductive member bare portion extending outside of said housing through an aperture at said inner end and adapted to electrically engage said case directly adjacent said aperture when said connector is mounted thereon.

2. The improvement of claim 1 wherein said cavity opens to the inner end of said housing and is defined by a base wall and side walls, said first conductive member bare portion extends across and adjacent to a first side wall, said second electrically conductive member extends across a second side wall opposite said first side wall, and said capacitor when positioned in said cavity is of a physical length to electrically engage at its opposite ends said bare portions of said conductive members.

3. The improvement of claim 1 wherein said cavity opens to the inner end of said housing and is defined by a base wall, and side walls, said first conductive member bare portion is adjacent to said base wall, said second terminal faces the open end of said cavity, and said second electrically conductive member extends across said opening.

4. The improvement of claim 1 wherein said capacitor is in the shape of a cube with first and second opposite ends of said cube forming the first and second terminals of said capacitor and said first conductive member bare portion and said second conductive member bare portion in engagement with said capacitor terminals over an area generally equal to the area of said terminals.

5. The improvement of claim 1 wherein the thickness of said bare portions the spacing between the terminals of said capacitor and the length of said cavity are such that the capacitor and the bare portions fit tightly in said cavity with the terminals of said capacitor in firm physical engagement with said bare portions.

6. An electrical connector adapted to be mounted on the metal case of electrical apparatus comprised of a body of electrically insulating material, including a base portion and wall portions extending therefrom to define an open ended cavity defined by a base surface and oppositely facing wall surfaces, a first electrically conductive member having a first portion extending through said base portion and a second portion extending along surfaces of said cavity to a point external of said cavity through said open end, at least a part of said second portion along said cavity surface being bare, said cavity being adapted to receive a capacitor element in the shape of a cube with two opposite ends of said cube forming first and second terminals of said capacitor having an area generally equal to the cross sectional area of said cube, with said first terminal engaging with said bare part and said second terminal engaging a second conductive member extending outside of said connector body at the open end of said cavity and into immediate electrical contact with said metal case immediately adjacent said opened ended cavity.

7. An electrical connector adapted to be mounted on the casing of electrical apparatus and suppress high frequency electrical energy generated within the casing of said electrical apparatus, said connector comprising a generally cylindrical housing of electrically insulating material, means at one end of said housing for coacting with and mounting said housing on said casing, said end of said housing having a cavity therein, said cavity being defined by a base and at least a wall; a first electrically conductive member extending through said housing, across at least a portion of said cavity base, along a wall of said cavity, and beyond the end of said cavity and having means thereat for connecting to said electrical apparatus, a capacitor having first and second opposite ends thereof forming its first and second terminals positioned in said cavity with said first terminal in pressure engagement with a portion of said first conductive member where exposed in said cavity, and a second electrically conductive member in pressure engagement with said second terminal of said capacitor and including a portion extending out of said cavity for engagement with the casing of said apparatus immediately adjacent said cavity.

8. An electrical connector for fixedly coupling to the case of an electrical apparatus said connector including: a base of electrically insulative material said base supporting an electrical power conductor element extending through said base and exposed at its inner end for providing electrical power connection to said electrical apparatus, said base including means integral said inner end for fixedly coupling said base to said case of said electrical apparatus, a cavity with at least part of said conductor element exposed therein and forming part of the interior thereof, formed within said base, said cavity being adjacent to a portion of said case, said cavity adapted to receive a capacitor element, said capacitor having a butt terminal at a first end and insertable into said cavity so that said butt terminal makes close electrical contact with said conductor element exposed within said cavity and a short low impedance terminal at a second end of said capacitor for connecting said second end directly to a ground connection whereby radio frequency energy normally generated by operation of said electrical apparatus is substantially suppressed at the source of such generation by the capacitive characteristics of said capacitor and any antenna function of the connection between the electrical components for radiating said radio frequency energy is virtually eliminated.

9. In a connector adapted to be mounted on the case of electrical apparatus said connector including an insulative housing having an inner end nearest said electrical apparatus and an outer end, means integrated therein at said inner end thereof for cooperatively mounting on said case in fixed relation thereto, a fixed electrically conductive member extending through said housing having a first exposed end at the outer end of said housing for detachably receiving a non-fixed electrically conductive member for completing a power circuit and a second exposed end of said fixed conductor at said inner end of said housing for providing electrical connection to said electrical apparatus, the improvement which comprises: a cavity in said housing defined by a plurality of walls and at least one space providing access to said cavity, said first conductive member having a bare portion thereof exposed within the inside of said cavity, an electrical capacitor positioned in said cavity and having a first end defining an ultra-short, low impedance first terminal electrically connected with said bare portion and a second end defining a second ultra-short low impedance terminal and, a second electrically conductive member in electrical contact with said second terminal and extending outside said cavity of said housing for electrically engaging said case when said connector is mounted thereon.

10. In a connector adapted to be mounted on a metal case of electrical apparatus, which connector includes: a fixed housing having means at its inner end for coacting mounting on said case; and, a fixed electrically conductive member extending through said housing having a first exposed end at the outer end of the housing for detachable electrical connection to a movable electrically conductive member and a second exposed end at the inner end of the housing for electrical connection to said electrical apparatus: the improvement which comprises: said housing having a cavity opening on said housing inner end defined by a base wall, a plurality of side walls and an intermediate wall, said fixed conductive member having a bare portion extending across and adjacent to said intermediate wall between said intermediate wall and a first side wall inside of said cavity; an electrical capacitor positioned in said cavity and having a first end forming a first terminal electrically connected with said fixed conductive member bare portion by means of a U-shaped third conductive member having a pair of parallel extending legs, one leg positioned on each side of said intermediate wall, one leg engaging said bare portion of said fixed conductive member and the other leg engaging said first terminal of said capacitor, and a second end forming a second terminal; and, a second electrically conductive member in electrical contact with said second terminal and having a second electrically conductive member bare portion extending across a second side wall opposite said intermediate wall extending outside of said housing and adapted to electrically engage said case when said connector is mounted thereon.

11. In a connector adapted to be mounted on a metal case of electrical apparatus, which connector includes: a fixed housing having means at its inner end for coacting mounting on said case; and, a fixed electrically conductive member extending through said housing having a first exposed end at the outer end of the housing for detachable electrical connection to a movable electrically conductive member and a second exposed end at the inner end of the housing for electrical connection to said electrical apparatus: the improvement which comprises: said housing having a cavity with an open end on the inner end of said housing defined by a base wall and side walls, said fixed conductive member having a bare portion exposed to the inside of said cavity adjacent said base wall; an electrical capacitor positioned in said cavity and having a first end forming a first terminal electrically connected with said fixed conductive member bare portion and a second end forming a second terminal facing the open end of said cavity; and, a second electrically conductive member in electrical contact with said second terminal and having a bare portion extending across said second terminal and through openings in the side of said housing adjacent to the inner end thereof and reversely bent so as to overlap intermediate portions of said second conductive member outside of said housing and adapted to electrically engage said case when said connector is mounted thereon.

12. An electrical connector adapted to be mounted on the casing of electrical apparatus and suppress high frequency electrical energy generated within the casing of said electrical apparatus, said connector comprising a generally cylindrical housing of electrically insulating material, means at one end of said housing for coacting with and mounting said housing on said casing, said end of said housing having a cavity therein, said cavity being defined by a base and at least a side wall; a first electrically conductive member extending through said housing, across at least a portion of said cavity base, along a wall of said cavity, and beyond the end of said cavity and having means thereat for connecting to said electrical apparatus, a capacitor having first and second opposite ends thereof forming its first and second terminals positioned in said cavity with said first terminal in pressure engagement with a portion of said first conductive member where exposed in said cavity, and a second electrically conductive member extending across the open end of said cavity in pressure engagement with said second terminal of said capacitor and including a portion extending out of said cavity through a pair of oppositely disposed slots in said housing adjacent the open end of said cavity and the ends of said member are reversely bent to overlap the intermediate portions thereof for engagement with the casing of said apparatus immediately adjacent said cavity.

* * * * *

UNITED STATES PATENT AND TRADEMARK OFFICE

CERTIFICATE OF CORRECTION

PATENT NO. : 4,205,891

DATED : June 3, 1980

INVENTOR(S) : Willis E. Rieman, Robert J. Duffany

It is certified that error appears in the above-identified patent and that said Letters Patent are hereby corrected as shown below:

In the drawings, Sheet 4, Fig. 14, the reference numeral 150 should be applied to the space below and between the ear 175 and the cross-sectional base 140; Column 1, line 24, after "motor" insert -- and --. Col. 2, line 38, "minimum" second occurrence should read -- maximum --. Column 3, line 39, "cavity an" should read -- cavity and an -- ; line 56 "arrangements" should read -- arrangement --. Column 4, line 26, "9 - 9" should read -- 11-11 --; line 60, delete reference numeral "18". Column 5, line 12, after "portion" insert reference numeral -- 36 --; line 13, delete reference numeral "36"; line 14, "walls" should read -- wall --; line 30, reference numeral "54" should read -- 56 --; line 34, "define" should read -- defines--; line 50, reference numeral "52" should read -- 60 --. Column 6, line 5, "an" should read -- and --; lines 12-13, "(143 mm)" should read -- (15.2 mm) --; line 16, "(125 mm)" should read -- (12.7 mm) --; line 37, reference numeral "52" should read -- 60 --; Column 3, line 55, after "the" insert --invention is the --.

UNITED STATES PATENT AND TRADEMARK OFFICE

CERTIFICATE OF CORRECTION

PATENT NO. : 4,205,891

DATED : June 3, 1980

INVENTOR(S) : Willis E. Rieman, Robert J. Duffany

It is certified that error appears in the above-identified patent and that said Letters Patent are hereby corrected as shown below:

line 48, "legs" should read -- leg --; line 59, reference numeral "52" should read -- 60 --. Column 7, line 8, "shows" should read -- show --; line 53, "define" should read -- defined --; line 55, reference number "119" should read -- 118 --. Column 8, line 3, delete "are"; line 4, after "lugs" insert -- 107 --; line 28, reference numeral "130" should read -- 140 --; line 29, after "cavity" insert reference numeral -- 150 --; line 49, delete "contact with this bare portion"; line 59, "of" second occurrence should read --or--. Column 9, line 3, reference numeral "170" should read -- 174 --; line 38, "position" should read -- positive --; line 52, "proving" should read -- providing --; line 55, "object" should read -- objects --; line 55, after the semi-colon(;) insert -- includes --; line 60, after "of" (second occurrence) insert a comma (,); line 61, after "apparatus" insert a comma (,). Column 11, line 2, "opened" should read -- open --. Column 14, line 10, "are" should read -- being --.

Signed and Sealed this

*Seventh* Day of *April 1981*

[SEAL]

*Attest:*

RENE D. TEGTMEYER

*Attesting Officer*

*Acting Commissioner of Patents and Trademarks*